United States Patent [19]

Clompus

[11] 4,351,170

[45] Sep. 28, 1982

[54] KEY ACTUATED LOCKING BOLT

[76] Inventor: I. Bertram Clompus, 111 Harvest La., Phoenixville, Pa. 19460

[21] Appl. No.: 183,528

[22] Filed: Sep. 2, 1980

[51] Int. Cl.[3] ..... E05B 65/08

[52] U.S. Cl. ..... 70/90; 70/95; 70/371; 292/DIG. 20; 292/DIG. 46

[58] Field of Search ..... 292/DIG. 20, DIG. 46, 292/DIG. 47; 70/90, 100, 95, 371

[56] References Cited

U.S. PATENT DOCUMENTS

| | | | |
|---|---|---|---|
| 1,144,289 | 6/1915 | Blair et al. | 292/DIG. 20 X |
| 1,244,725 | 10/1917 | Gadke | 292/DIG. 20 X |
| 2,076,897 | 4/1937 | Kistner | 70/90 |
| 2,091,199 | 8/1937 | Fraim | 70/90 |
| 2,098,189 | 11/1937 | Kistner | 70/90 |
| 2,131,315 | 9/1938 | Dunseath | 70/90 |
| 3,071,957 | 1/1963 | Golub | 70/95 X |
| 3,881,333 | 5/1975 | Christmas | 292/DIG. 20 X |
| 4,009,599 | 3/1977 | Patriquin | 70/90 |

*Primary Examiner*—William E. Lyddane

*Attorney, Agent, or Firm*—Seidel, Gonda, Goldhammer & Panitch

[57] ABSTRACT

A key actuated locking bolt is provided for use with first and second frame members of the window or door type having overlapping portions when in a closed position. A bolt and plug are connected together and integral in one piece for selective removal from a housing bolted to an interior side face of one of the overlapping portions. The bolt is substantially longer than the plug and adapted to extend through aligned holes in the overlapping frame portions. Key operated tumbler means are associated with the plug to facilitate rotation of the plug and bolt relative to the housing between locked and unlocked positions.

8 Claims, 7 Drawing Figures

FIG. 1
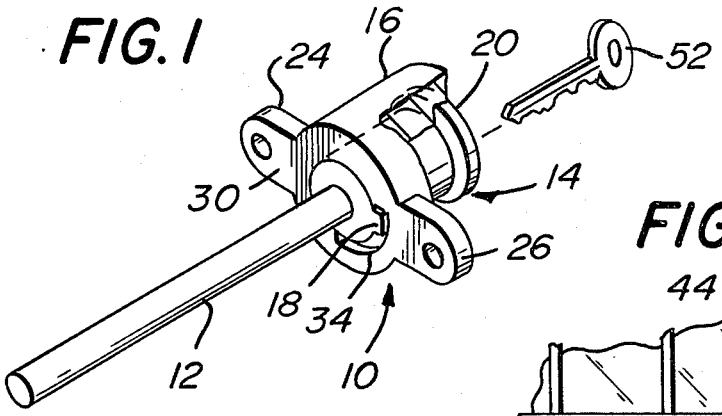
FIG. 3
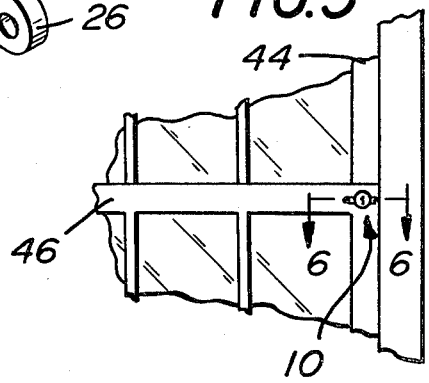
FIG. 7
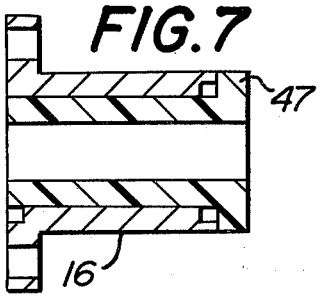
FIG. 2
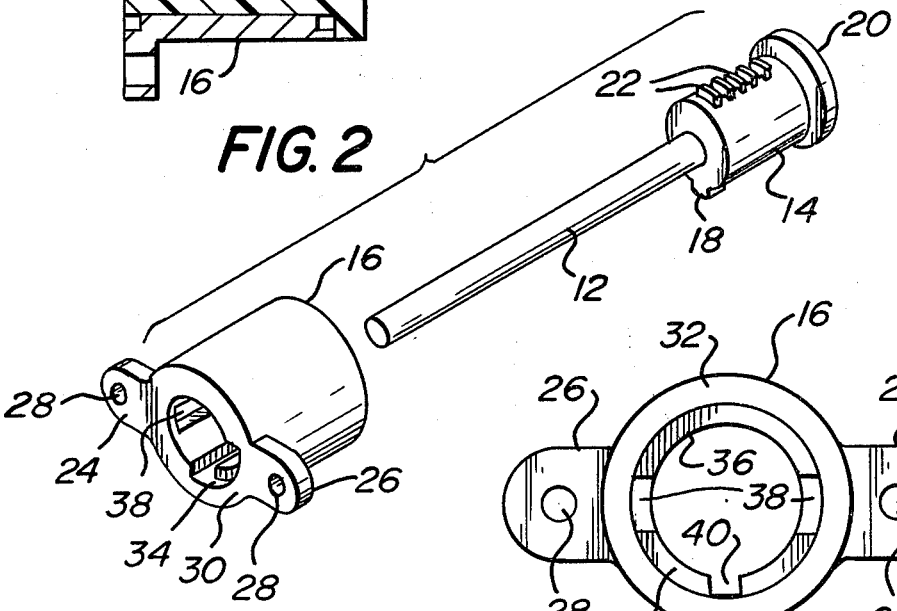
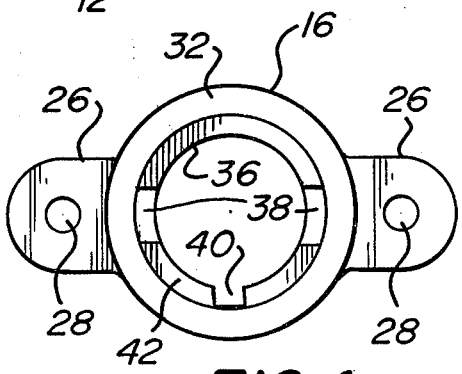
FIG. 4

KEY ACTUATED LOCKING BOLT

BACKGROUND OF THE INVENTION

Key actuated locking bolts are known. See U.S. Pat. Nos. 2,098,189 and 2,076,897. Referring to FIG. 6 of Patent 2,098,189 it will be noted that the locking bolt is partially disposed in the overlapping frame members and spring biased to a position wherein the bolt is disposed entirely within one of the frame members. In order to install the bolt as shown in FIG. 6 of Patent 2,098,189 it is necessary to separately drill different holes of different diameters in the overlapping frame members, bushing 31 is secured in place by projection 35, whereby installation is more complicated than necessary. At the same time, the number of components associated with the bolt in the last mentioned patent are substantially greater in number than necessary. Further, the locking bolt in the last mentioned patent is not readily adaptable for use in connection with overlapping door members on a sliding door such as a patio door having hollow aluminum frame members.

SUMMARY OF THE INVENTION

The locking bolt of the present invention is adapted for use with first and second frame members of the window or door type having overlapping portions when in a closed position. The device includes a bolt having a length sufficient to extend through the thickness of one of the overlapping frame members and enter an aligned hole in the mating overlapping frame member. A plug is fixedly connected to one end of the bolt. The plug has a length substantially shorter than the length of the bolt. A locking lug projects radially outwardly from the plug adjacent said one end.

The present invention includes a discrete housing adapted to be bolted to an exterior side face of one overlapping frame portion. The housing has a passage therethrough. The plug is rotatably supported by the housing passage for rotation between a locked position wherein said lug engages a mating surface on the housing for prevention of relative reciprocation between the housing and the plug and an unlocked position wherein the bolt and plug are bodily removable from the housing. The housing has a groove on its inner periphery for accomodating the lug during removal of the plug and bolt from the housing. The plug has an axial length approximately equal to the axial length of the housing. The housing has mounting holes parallel to the axis of said passage. Key operated tumbler means are associated with the plug for facilitating rotation of the plug and bolt relative to the housing between the locked and unlocked positions thereof.

It is an object of the present invention to provide a key actuated locking bolt which is adapted for use with first and second frame members of the window or door type having overlapping portions when in a closed position while being simple, reliable, inexpensive and easy to install.

It is another object of the present invention to provide a key actuated locking bolt for use with first and second frame members of the window or door type having overlapping portions when in a closed position and wherein mounting screws cannot be popped by using a crow-bar to separate the overlapping frame members.

Other objects will appear hereinafter.

For the purpose of illustrating the invention, there is shown in the drawing a form which is presently preferred; it being understood, however, that this invention is not limited to the precise arrangements and instrumentalities shown.

FIG. 1 is a perspective view of a key actuated locking bolt in accordance with the present invention.

FIG. 2 is a perspective exploded view of the device shown in FIG. 1.

FIG. 3 is a elevation view of overlapping window shashes locked by the device of the present invention.

FIG. 4 is a front elevation view of the housing.

FIG. 7 is a sectional view of the housing containing an expendable drill guide tube.

DETAILED DESCRIPTION

Figure 5:
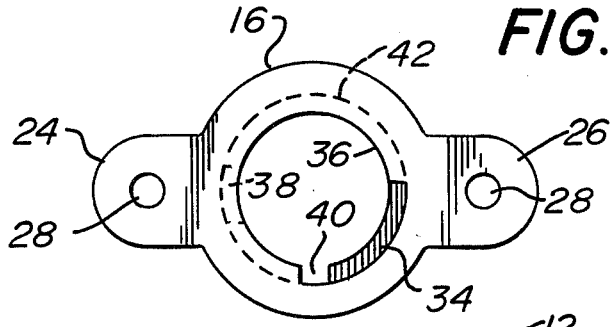
FIG. 5 is a rear elevation view of the housing.

Referring to the drawing in detail, wherein like numerals indicate like elements, there is shown in FIG. 1 a key actuated locking device in accordance with the present invention designated generally as 10. The device 10 is comprised of three major components, namely the bolt 12 having one end integral in one piece with the plug 14, and the housing 16. The plug 14 is approximately ⅓ the length of the bolt 12 and has a radially outwardly directed lug 18 adjacent the end connected to the bolt 12. Plug 14 at its outer end may be provided with a radially outwardly directed flange 20. Plug 14 is provided with radially outwardly directed spring biased disk tumblers 22 for actuation by a key. Preferably, there are five such disk tumblers.

The housing 16 has a pair of ears 24 and 26 extending in opposite directions from the inner end 30. Holes 28 are provided in the ears 24, 26. One side face of the ears 24, 26 is flush with the inner end face 30. Adjacent the end face 30, the housing 16 is provided with an arcuate slot 34 recessed inwardly from said end face.

Housing 16 is preferably cylindrical and has a cylindrical bore 36 whose axis is parallel to the axis of the holes 28. Bore 36 has a pair of radially outwardly directed groove 38 for receiving the disk tumblers 22. Grooves 38 preferably do not extend for the entire length of bore 36. Bore 36 also has a longitudinally extending groove 40 for accomodating the lug 18. Grooves 38 and 40 are preferably 90° apart as shown in FIG. 4. As shown more clearly in FIG. 2, the inner end of groove 40 communicates directly with the arcuate slot 34.

The outer end face 32 of the housing 16 may be provided with a recess 42 if desired. As shown more clearly in FIG. 6, the recess 42 has a depth corresponding to the thickness of the flange 20 which is disposed therewithin.

Figure 6:
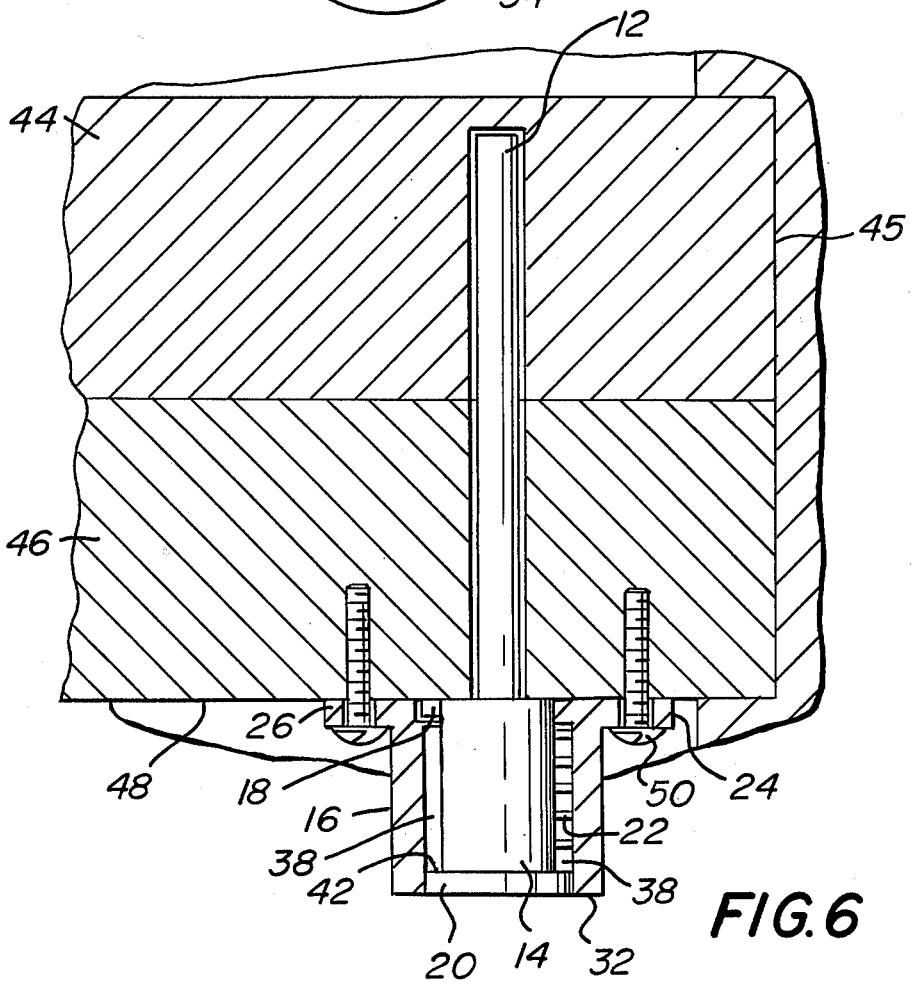
FIG. 6 is a sectional view taken along the lines 6—6 in FIG. 3 but on an enlarged scale.

The present invention is adapted for use with doors such as patio doors or windows having overlapping sashes. Referring to FIGS. 3 and 6, there is illustrated overlapping frame members 44 and 46 within a frame or track 45. The members 44 and 46 are adapted to sliding movement relative to one another with the interface being generally vertically disposed. Frame member 46 has a vertically disposed side face 48 on the inside of the room or building.

The device of the present invention is utilized as follows. A disposable drill guide tube 47 is placed in bore 36 of housing 16. See FIG. 7. Face 30 of housing 16 is placed against one of the overlapping members in the desired location. A drill is inserted through the tube 47 to insure that the drilled hole is horizontal and not angled upwardly, downwardly or sidewise. A hole is drilled through the overlapping frame members 44, 46 with a sufficient diameter so as to accomodate the bolt 12. Thereafter tube 47 is discarded.

The bolt 12 and plug 14 are locked to the housing 16 and key 52 is removed. Then bolt 12 is inserted into the drilled hole. Then housing 16 is secured in position by way of fasteners 50. Installation is now complete. The frame members are unlocked as follows. Key 52 is inserted through the key hole in the end face of the plug 14 to thereby withdraw the disk tumblers 22 radially inwardly from grooves 38 and facilitate rotation of the plug 14 through an arc of 90°. Such rotation of the plug 14 causes the lug 18 to rotate to a position aligned with groove 40 from a position where lug 18 was disposed in the slot 34. Thereafter, key 52 and plug 14 with bolt 12 are removed as a unit.

Since the fasteners 50 are perpendicular to the interface between members 44, 46, fasteners 50 are not effected by use of a crow-bar. Fasteners 50 are preferably one way screws which cannot be removed with a screw driver. Key 52 should be a standard weight paracentric key. The frame members 44, 46 may be solid as shown or hollow as is the case in connection with aluminum frame members on sliding glass patio doors. Only a hole for accomodating the bolt 12 need be drilled in connection with wooden frame members 44, 46. With aluminum frame members, predrilled holes will have to be provided for the fasteners 50 as well as for bolt 12. Holes 28 are used as guides for predrilling the holes for fasteners 50.

It will be noted that the number of components of the present invention are minimal and of standard shape so that they may be made without the need for intricate machining. Installation is simple and rapid. The diameter of bolt 12 need not be more than ¼ inch whereby conventional drills may be used to provide the holes in the overlapping frame members 44, 46. The components are preferably made from a strong metal with a noncorrosive finish. In a typical embodiment, bolt 12 has a length of approximately 2½ inches.

The frame members 44, 46 may have glass windows as shown in FIG. 3. Breaking the glass windows will not facilitate entry since key 52 is necessary to attain withdrawl of the bolt 12 and plug 14. Since the fasteners 50 are perpendicular to the interface between the members 44, 50, force applied in a direction to separate the members 44, 50 will not pop the fasteners 50 as would be the case if the fateners were parallel to the interface. In view of the presence of the disk tumblers 22 or equivalent device, it is not possible to turn the plug 14 merely by inserting a screwdriver or equivalent device into the keyhole therein.

The present invention may be embodied in other specific forms without departing from the spirit or essential attributes thereof and, accordingly, reference should be made to the appended claims, rather than to the foregoing specification, as indicating the scope of the invention.

I claim:

1. A lock for use with first and second frame members of the window or door type having overlapping portions when in the closed position comprising:

(a) a bolt having a length sufficient to extend through the thickness of one of the overlapping frame members and enter a blind hole in the mating overlapping frame members;

(b) a plug fixedly connected to and coaxial with one end of said bolt and having a length substantially shorter than the length of the bolt, a locking lug projecting radially outwardly from the plug adjacent said one end;

(c) a discrete housing adapted to be bolted at one end to an interior side face of one overlapping frame member, said housing having a passage therethrough, said plug being insertable in said passage from the other end of said housing and rotatably supported in said housing passage for rotation between a locked position when the lug engages a mating surface adjacent said one end on the housing for prevention of relative reciprocation between the housing and the plug and an unlocked position wherein the bolt and plug are bodily removable from said housing, said housing having a longitudinally extending groove on its inner periphery for accommodating said lug during removal of the plug and bolt from said housing, said plug having an axial length approximately equal to the axial length of said housing, said housing having mounting holes parallel to the axis of said passage; and (d) key operated tumbler means associated with said plug for facilitating rotation of the plug and bolt relative to said housing between the locked and unlocked positions.

2. A lock in accordance with claim 1 wherein said housing passage has at least one additional groove on its inner periphery, said second groove being spaced from said first mentioned groove by 90 arcuate degrees and being adapted to accomodate the tumbler means during locked position of bolt and plug in said housing.

3. A lock in accordance with claim 1 wherein said housing has mounting ears at said one end thereof, said mounting ears having said mounting holes therethrough, and the end face of said one end of said housing having an arcuate slot for accomodating said lug, one end of said slot intersecting said groove.

4. A lock in accordance with claim 1 wherein said plug has a radially outwardly directed flange at the end thereof remote from said bolt, said other end of said housing having a recess for accomodating said flange.

5. Apparatus comprising first and second frame members vertically disposed and having overlapping portions when in a closed position, at least one of said frame members being moveable with respect to the other, at least one of said frame members having a glass panel, said overlapping portions having aligned holes, the hole in said first frame member being blind while the hole in said second frame member extending therethrough, a bolt having a length corresponding generally to the combined length of said holes, a plug integral in one piece and coaxial with said bolt and having a length substantially shorter than the length of the bolt, a locking lug projecting radially outwardly from the plug adjacent said one end, a housing secured at one end to a vertically disposed side face of said second frame member and coaxial with said holes, said housing having a passage therethrough, said plug being rotatably supported within said passage for rotation between a locked position wherein the lug engages a mating surface on the housing for prevention of relative reciprocation between the housing and plug and an unlocked position wherein the bolt and plug are bodily removable from said housing and said holes, said housing having a groove on its inner periphery for accomodating said lug during removal of the plug and bolt from said housing, said plug having an axial length approximately equal to the axial length of said housing, said housing having ears at one end adjacent said second frame member, said ears having at least one hole parallel to the axis of said passage, and key operated tumbler means associated with said plug for facilitating rotation of the plug and bolt relative to said housing between said locked and unlocked positions and vice versa.

6. Apparatus in accordance with claim 5 wherein said mating surface on said housing is an arcuate slot at said one end of said housing, one end of said slot communicating with said groove.

7. Apparatus in accordance with claim 6 wherein the tumbler means are a plurality of tumbler disks spring biased radially outwardly.

8. Apparatus in accordance with claim 6 wherein said housing is secured with one way screws.

* * * * *